US005673785A

United States Patent [19]

Schlaak et al.

[11] Patent Number: 5,673,785

[45] Date of Patent: Oct. 7, 1997

[54] MICROMECHANICAL RELAY

[75] Inventors: Helmut Schlaak; Joachim Schimkat, both of Berlin, Germany

[73] Assignee: Siemens Aktiengesellschaft, Munich, Germany

[21] Appl. No.: 538,367

[22] Filed: Oct. 3, 1995

[30] Foreign Application Priority Data

Oct. 18, 1994 [DE] Germany ..... 44 37 259.0

[51] Int. Cl.[6] ..... H01H 1/24

[52] U.S. Cl. ..... 200/245; 200/181; 267/161; 267/163

[58] Field of Search ..... 200/245, 516, 200/275, 181; 267/161, 163, 158

[56] References Cited

U.S. PATENT DOCUMENTS

| | | | |
|---|---|---|---|
| 3,089,342 | 5/1963 | Willis | 267/163 X |
| 3,950,846 | 4/1976 | Johnson | 200/516 X |
| 4,066,860 | 1/1978 | Kawasaki | 200/516 X |

FOREIGN PATENT DOCUMENTS 42 05 029 C1 11/1993 Germany .

*Primary Examiner*—Renee S. Luebke
*Attorney, Agent, or Firm*—Hill, Steadman & Simpson

[57] ABSTRACT

The micromechanical electrostatic relay has, on the one hand, a base substrate with base electrode and a base contact piece and, on the other hand, an armature substrate with an armature spring tongue that is etched free and curved away from the base substrate, and that has an armature electrode and an armature contact piece. When a control voltage is applied between the two electrodes, the spring tongue unrolls on the base substrate until it is stretched and causes the two contact pieces to touch. In order to obtain a high contacting force given an optimally large electrode area, the armature contact piece is arranged on a contact spring section that is cut free from the spring tongue via spring webs in the form of a sun wheel with spoke sections helically interengaging such that it is surrounded on all sides by the spring tongue.

9 Claims, 4 Drawing Sheets

MICROMECHANICAL RELAY

RELATED APPLICATIONS

The present application is related to copending application Hill Firm Case Nos. P95.2361 Ser. No. 08/539,012 filed Oct. 3, 1995—"MICROMECHANICAL RELAY" and P952360Ser. No. 08/538,440 filed Oct. 3, 1995—"MICROMECHANICAL ELECTROSTATIC RELAY".

BACKGROUND OF THE INVENTION

The invention is directed to a micromechanical electrostatic relay having a base substrate that carries a base electrode layer and a base contact piece, and having an armature substrate that lies on the base substrate and has an armature spring tongue that is worked free and attached at one side and that carries an armature electrode layer and an armature contact piece in the proximity of its free end on a partially cut-free contact spring section. The spring tongue, in the quiescent condition, forms a wedge-shaped air gap with its armature electrode layer relative to the base electrode layer, and conforms to the base substrate in the working condition when a voltage is present between the two electrodes, so that the two contact pieces lie against one another upon elastic deformation of the contact spring section.

DE 42 05 029 C1 already discloses such a micromechanical relay. As set forth therein, such a relay structure can be manufactured, for example, of a crystalline semiconductor substrate, preferably silicon, whereby the spring tongue serving as an armature is worked out of the semiconductor substrate by appropriate doping and etching processes. By applying a control voltage between the armature electrode of the spring tongue and the planar base electrode, the curved spring tongue rolls on the cooperating electrode and thus forms what is referred to as a migrating wedge. The spring tongue is stretched during this rolling until the free end with the armature contact piece touches the base contact piece on the base substrate.

An exemplary embodiment in the above-recited patent also shows a spring tongue wherein the contact spring section that carries the armature contact piece is partially cut free by longitudinal slots parallel to the longitudinal sides of the spring tongue. What is thereby achieved is that the remaining sections of the spring tongue behind and next to the contact spring section can place themselves in flat fashion onto the base electrode, whereas the contact spring section itself bends slightly upward due to the height of the contact pieces and thus produces a desired contacting force.

The spring stiffness of the contact spring section and the curve of the switching characteristic can be influenced by varying the length and the position of the slots. It can be stated in general, given the contact tongue partitioned by two parallel, longitudinal slots, that an optimally short and broad contact spring is given great stiffness and could thus also generate a high contacting force as desired. However, this would be done at the expense of the electrode area. The attractive voltage would be increased and the desired trip characteristic when closing and opening the contact would deteriorate. Stated in simplified terms, a relatively hard contact spring region that is coupled relatively stiffly to the armature spring tongue via the line between the two longitudinal slots respectively causes an uncertain switch behavior in the region of the response voltage and the drop-off voltage. This is because the parts of the armature electrode located to the side of the contact spring section are placed against the base electrode too late, or prematurely lift off when the holding voltage is reduced.

SUMMARY OF THE INVENTION

In a micromechanical relay of the type initially cited, it is therefore an object of the present invention to design the contact spring section such that it requires optimally little area of the armature spring tongue but generates an optimally high contacting force at the same time due to its stiffness and enables an optimally complete application of the remainder of the spring tongue on the base electrode.

This object is achieved in that the contact spring section is surrounded on all sides by the spring tongue and is connected thereto axially symmetrically via spring webs in the form of a sun wheel whose spokes are limited by slots annularly arranged with mutual overlap whose angular ranges total more than 360°.

As a result of the coaxial attachment of the contact spring section to the actual spring tongue in the form of a sun wheel, this contact spring section can manage with a very small area that is only slightly larger than the actual contact piece. The attachment, namely, occurs via the sun wheel spokes in the form of torsion webs that, due to the limiting slots annularly overlapping one another, are approximately circular segments with which the desired mobility of the contact spring section relative to the spring tongue, on the one hand, and the required spring stiffness for achieving the contacting force, on the other hand, can be set in the tightest space by appropriate dimensioning of the length and width of these spokes. This rotational-symmetrical attachment via torsion elements thus requires significantly less space than a one-sided attachment via a long, tongue-shaped leaf spring.

In a preferred development, the slots for limiting the sun wheel spokes have the form of concentrically inter-engaging helical sections, whereby the length of the intervening sun wheel spokes can also be fixed by the length of these sections and the length of their overlap produced as a result thereof. On the other hand, the radial spacings of the slots define the width of the sun wheel spokes. The stiffness of the spring suspension for the contact spring section can thus be defined in a simple way. In order to enable the torsion of the sun wheel spokes, an overlap of the slots is required in any case, this deriving due to the total sum of their angular ranges of more than 360°. For a four-spoke sun wheel, this denotes respective angular ranges of the slots of more than 90°; in this case, the slots preferably have an angular range between 135° and 270°, this generally denoting, given an arbitrary plurality of spokes, that the sum of the angular ranges of the slots yields 1.5 to 3 times a full circle. The sun wheel employed here, of course, is not to be fixed at a plurality of four spokes. Dependent on the requirements, sun wheels having two, three or even more than four spokes can be employed. Multi-spoke sun wheels, however, lead to very narrow webs that would be unbeneficial for the interconnects to the switch contact. It need not be separately elucidated here, namely, that the supply of current to the armature contact piece must also occur via these sun wheel spokes. Conversely, extremely high mechanical stresses would occur at the ends of the slots given a two-spoke sun wheel.

As a result of the slots or sun wheel spokes interengaging rotational-symmetrically in a direction in the fashion of a coil spring, a tumbling emplacement of the contact or of the contact spring section and of the spring tongue serving as a drive as well is effected in the regions at the side of the contact spring section during the switching event, i.e. given the axial excursion and torsion of the spokes. This can lead to a frictional contact-closing event that can be advantageous in view of the contacting and the contact resistance but, on the other hand, may shorten the service life of the contact under certain circumstances.

In order to oppose this latter effect, it can be advantageous to hold the contact spring section with spring webs in the form of two concentrically arranged sun wheels, whereby the spokes of the two sun wheels form oppositely directed helix or coil arrangements. Instead of two fully fashioned, concentric sun wheels, however, it is also conceivable to curve the spokes of an individual sun wheel onto themselves, so that every spoke comprises two opposite, helical web sections. Two opposed turning events that mutually cancel in terms of their effect on the contact motion arise in this way.

The invention is set forth in greater detail below with reference to exemplary embodiments on the basis of the drawing.

DESCRIPTION OF THE PREFERRED EMBODIMENTS

Figure 1:
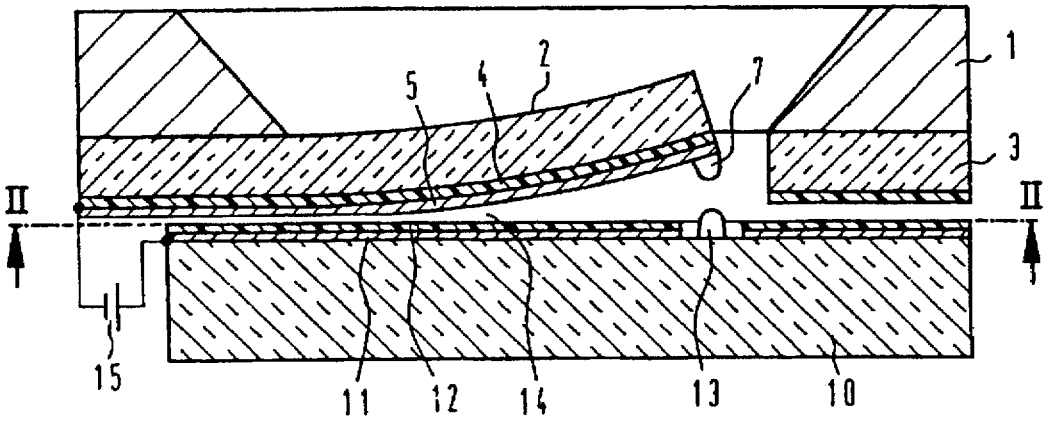
FIG 1 (PRIOR ART)
FIG. 1 is a schematic illustration of the basic structure of a micromechanical relay with a curved armature spring tongue, shown in section.

FIG. 1 schematically shows the basic structure of a micromechanical electrostatic relay wherein the invention is applied. At an armature substrate, preferably a silicon wafer, an armature spring tongue 2 is thereby worked free with selective etching processes within a corresponding doped silicon layer. A double layer 4 is produced at the underside of the spring tongue, this double layer 4 being composed in the example of a $SiO_2$ layer that produces compressive strains and of a $Si_3N_4$ layer that produces tensile stresses. The spring tongue can be given a desired curvature with an appropriate selection of the layer thicknesses. Finally, the spring tongue carries a metallic layer as an armature electrode 5 at its underside. This armature electrode 5, for example, is divided in two in order to permit a metallic lead to run to an armature contact piece 7 in the same plane.

The armature substrate 1 is secured on a base substrate 10 that is composed of pyrex glass in the present example but that, for example, could also be composed of silicon. On its planar surface, the base substrate 10 carries a base electrode 11 and an insulating layer 12 in order to insulate the base electrode 11 from the armature electrode 5. In a way not shown in detail, a base contact piece 13 is provided with a lead and, of course, is arranged in insulated fashion from the base electrode 11. A wedge-shaped air gap 14 is formed between the curved spring tongue 2 with the armature electrode, on the one hand, and the base electrode, on the other hand. When a voltage from a voltage source 15 is present between the two electrodes 5 and 11, the spring tongue unrolls on the base electrode 11, as a result of which the spring tongue stretches and the armature contact piece 7 is connected to the base contact piece 13. Let it also be mentioned that the size relationships and layer thicknesses in FIG. 1 are shown only from the point of view of clarity and do not correspond to the actual conditions.

Figure 2:
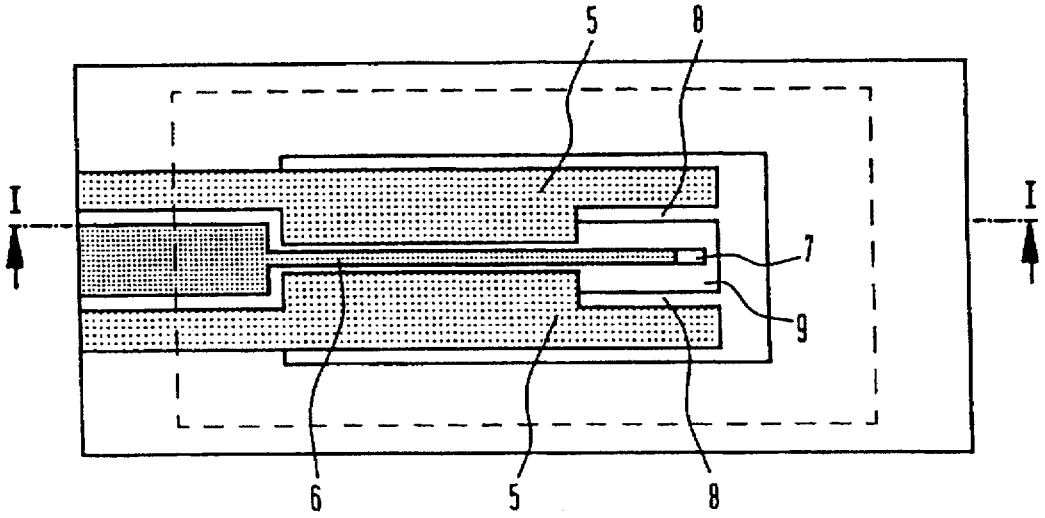
FIG 2 (PRIOR ART)
FIG. 2 is a view from below onto a spring tongue with a contact spring section limited with slots in a known way.

In order to generate a required contacting force for the two contact pieces when the armature electrode 5 lies flat on the base electrode 11, the contact piece 7 is arranged on a contact spring section that is partially cut free relative to the actual spring tongue 2, so that it can elastically deform and generate the contacting force in this way. FIG. 2 shows an example of a contact spring region or section 9 that has already been proposed. This contact spring section 9 is cut free by slots 8 parallel to the side edges of the spring tongue, so that the contact spring section itself has the shape of a leaf spring tongue. Due to the single-sided attachment of this contact spring section 9 at the spring tongue 2, the initially described problem results that this contact spring section requires a comparatively large amount of space that is in turn lost as electrode area at the spring tongue 2; and given the selection of a short, broad contact spring section 9 for achieving a high contacting force, the switch behavior may not be stable due to the stiff, single-sided coupling to the spring tongue in the region of the end of the slots 8 and to the electrode tabs at both sides of the contact spring section.

Figure 3:
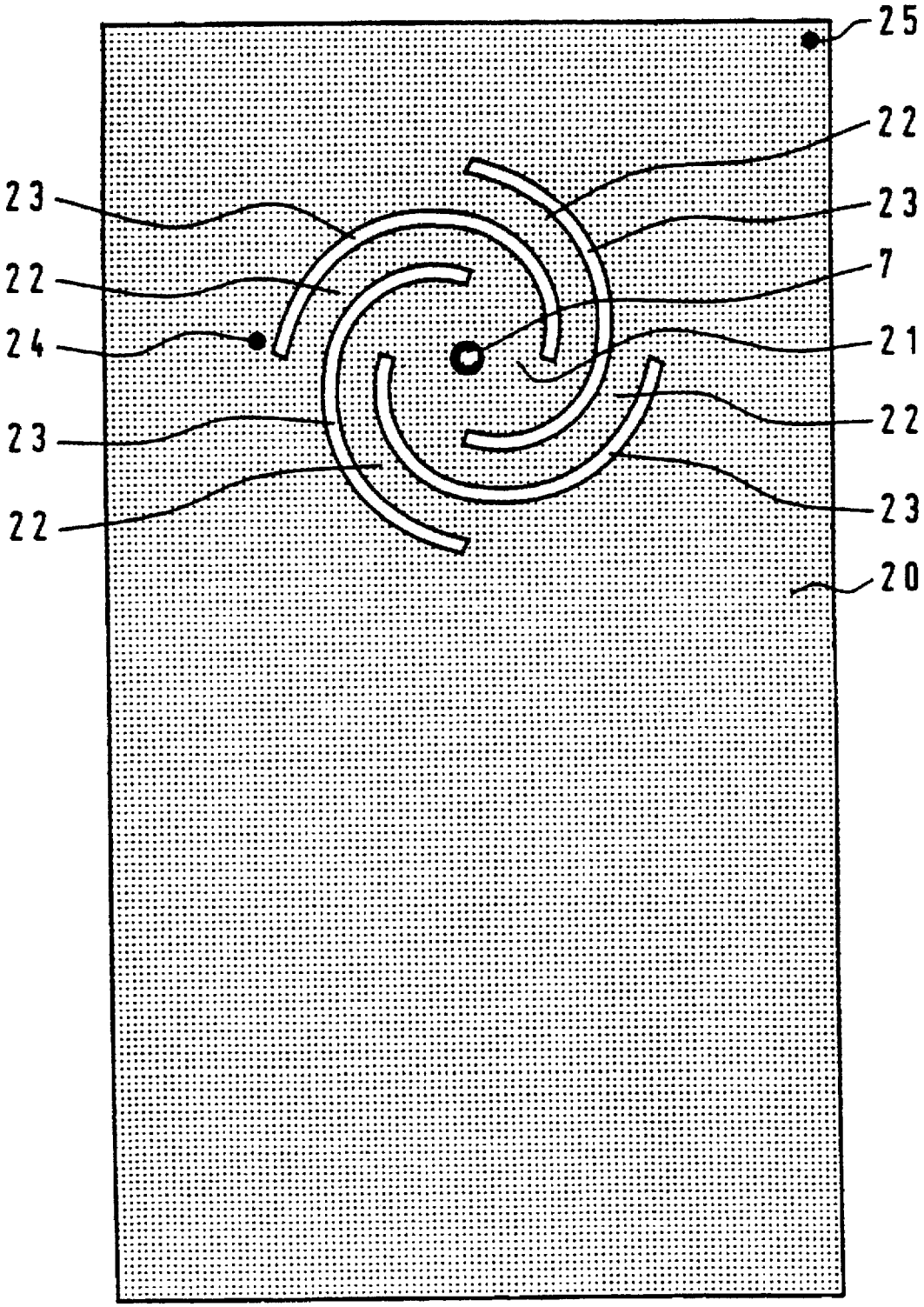
FIG. 3 is a spring tongue designed according to the invention in a plan view with helically limited contact spring section.

In a plan view, FIG. 3 shows the shaping of a spring tongue 20 wherein the contact piece 7 is carried by a rotational-symmetrical contact spring region 21 that is surrounded on all sides by the spring tongue 20. This contact spring region 21 is carded via spring webs 22 in the form of sun wheel spokes that are formed and separated from one another by slots 23, whereby these slots 23 are annularly arranged with mutual overlap as helical or coil sections. In the present example, the sun wheel has four spring webs or spokes 22, whereby the helical slots 23 serving the purpose of limitation cover an angular range of about 200°. An adequate overlap thus results in order to assure the torsion of the spring webs 22 given an axial motion of the contact piece 7. The spring webs can be made softer or stiffer, dependent on the length and spacing of the slots 23 in order to thus set the contacting force. At any rate, the spring webs must be made soft enough that the spring tongue 20 can lie in flat fashion on the base electrode 11 in the entire region all around the contact spring section 21.

An investigation of the switching behavior of a spring according to FIG. 3 was implemented with a computer simulation, whereby a structure of FIG. 3 having the following characteristics was selected:

| | |
|---|---|
| Total length of the spring tongue | 1750 μm |
| Width of the spring tongue | 1000 μm |
| Spacing of the contact piece from the clamping location of the spring tongue | 1300 μm |
| Length of the curved zone of the spring tongue | 400 μm |
| Width of the slots of the sun wheel | 20 μm |
| Angular range of the slots | 200° |

Figure 4A:
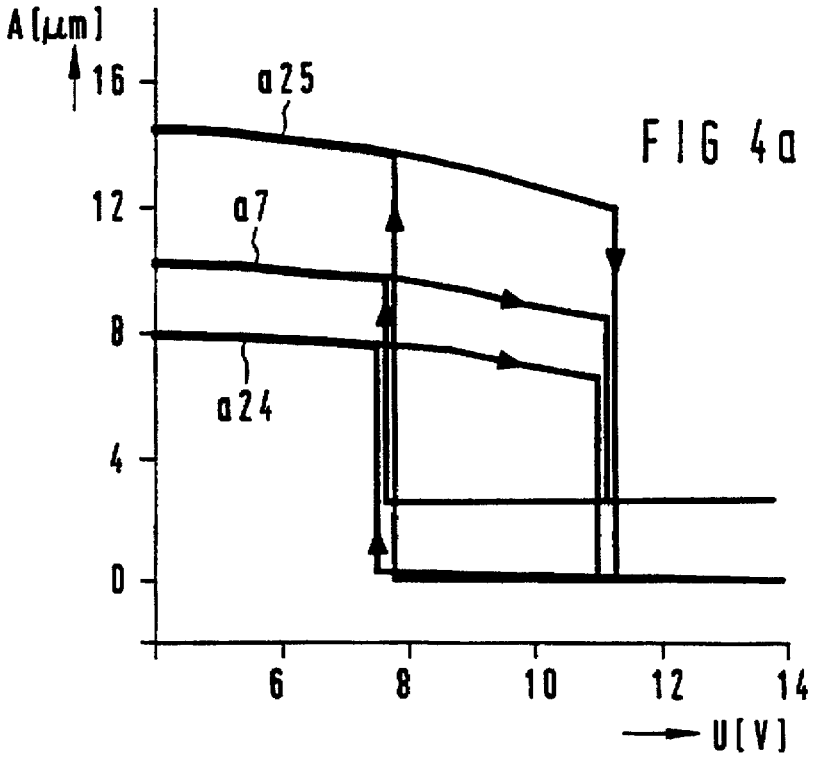
FIGS. 4*a* and 4*b* are two diagrams for illustrating the motion sequence of individual points of the coil spring as well as the curve of the contacting force dependent on the control voltage.
Figure 4B:
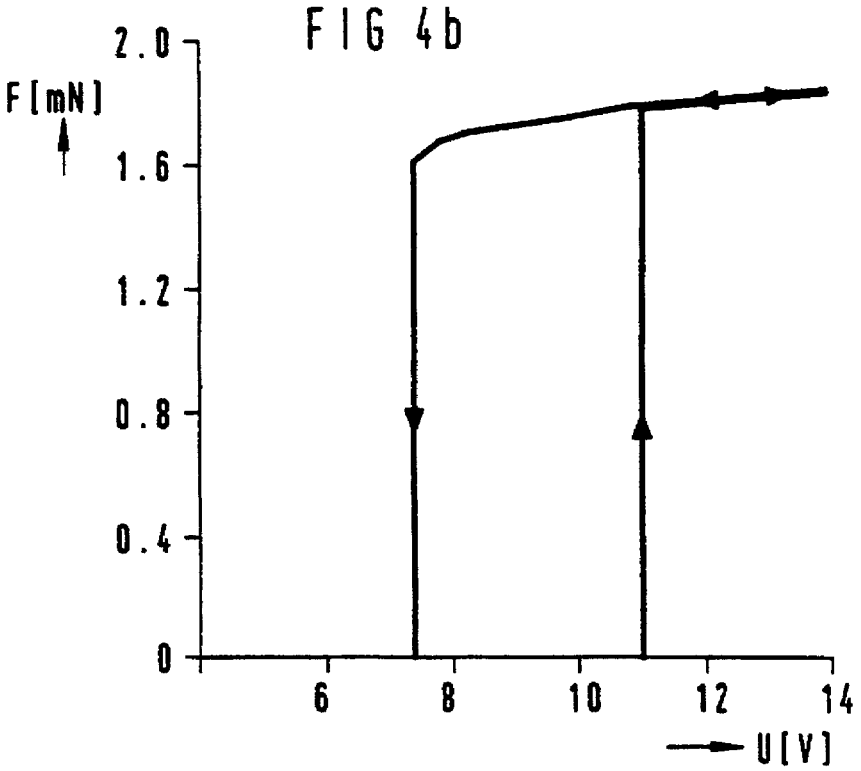

The results of the computer simulation are shown in FIGS. 4*a* and 4*b*. FIG. 4*a* shows the path of the spacing A at various points of the spring tongue 20 from the base electrode 11 during the switching event dependent on the control voltage. In detail, the curve a7 shows the path of the spacing for the contact piece 7, curve a24 shows the motion sequence for a point 24 next to the sun wheel and the curve a25 shows the motion of a point 25 at the tip of the spring tongue 20. The diagram of FIG. 4*a* shows unambiguous trip conditions both when closing as well as when opening. The curve of the contacting force according to FIG. 4*b* also shows unambiguous trip conditions. The response voltage lies at about 11 V, where the points 24 and 25 suddenly place themselves against the base electrode and the contact piece 7 is pressed against the cooperating contact piece 13. The spacing of the contact piece 7 from the base electrode does not become 0 in the attracted condition, but reaches the height of the base contact piece 13 of about 2.5 μm.

The stiffness of the attachment of the contact spring section via the sun wheel spokes must be dimensioned such that all points of the spring tongue 20 are also simultaneously seated against the base electrode at the response voltage. As the diagram of FIG. 4*b* shows, a contacting force of about 1.8 mN is achieved with a spring design according to FIG. 3. This is thus about five times as high as the contacting force that can be achieved with a contact spring section separated by simple slots according to FIG. 2.

Figure 5:
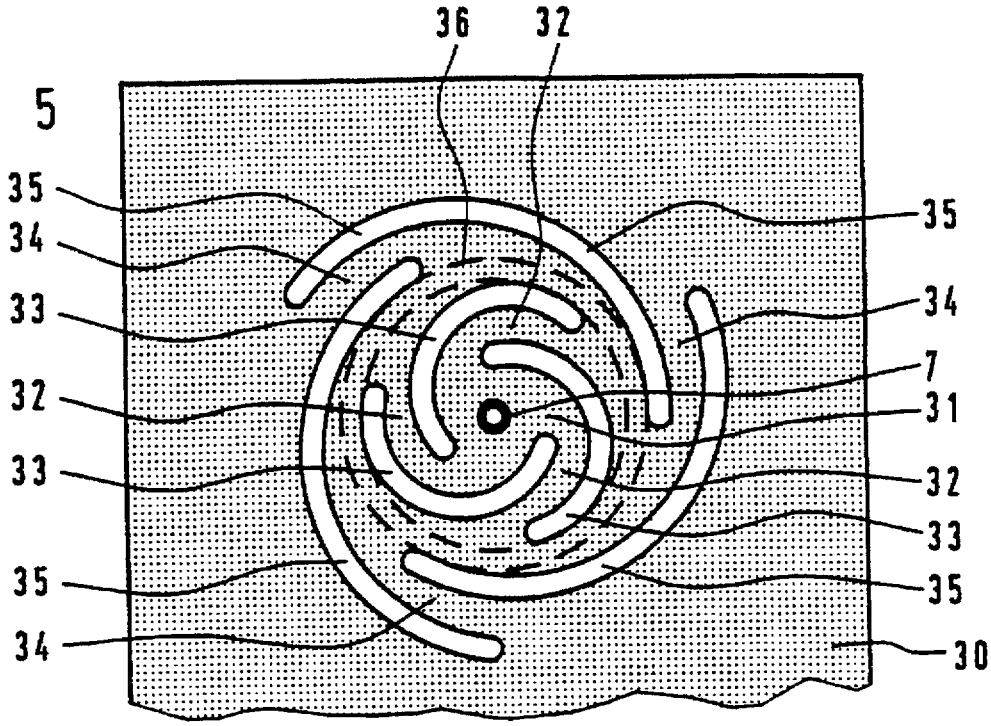
FIG. 5 is a spring tongue in a plan view, whereby the contact spring section is limited by two concentrically oppositely arranged sun wheel structures.

FIG. 5 shows a somewhat modified embodiment of a spring tongue 30. A contact spring section 31 is suspended with two concentric sun wheel arrangements, namely an inner sun wheel structure having respectively three spring spokes 32 and, correspondingly, three slots 33, as well as an outer sun wheel structure that again has three spring spokes 34 and three slots 35. The two sun wheel structures have a helical or coil arrangement with respectively opposite rotational sense such that the respective spokes of the two structures have increasing radius in opposite directions. The tumbling motion during the switching event caused by the single-sided torsion of the spring webs given the spring of FIG. 3 can be overcome in this way since the two sun wheel structures cause opposite rotational movements that cancel one another.

Figure 6:
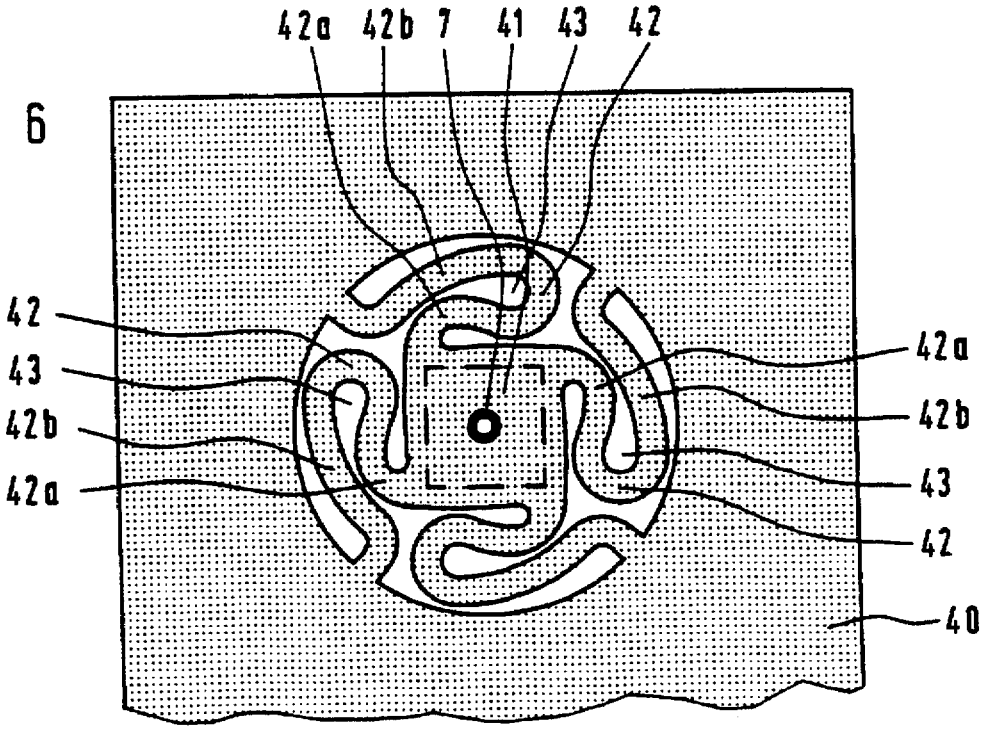
FIG. 6 is a spring tongue in a plan view with a contact spring section that is limited via a sun wheel structure with spokes oppositely curved in and of themselves.

Whereas two sun wheel structures lying inside one another are separated from one another by a concentric, continuous annulus 36 (indicated with broken lines) in the embodiment of FIG. 5, the same effect can also be achieved by an arrangement according to FIG. 6, whereby the spring spokes in a single sun wheel structure inherently have a curved course, so that torsional motions ensue in two opposite directions. According to FIG. 6, a contact spring section 41 is suspended in a spring tongue 40 via a sun wheel structure having four spring spokes 42 and intervening slots 43. Each of the spring spokes has a first spoke section 42*a* and a second spoke section 42*b* that adjoin one another in the fashion of a hairpin. Whereas the spoke sections 42*a* run into one another in the fashion of a helix having a right-hand turn, the outer spoke sections 42*b* are arranged in the fashion of a helix with a left-hand turn, whereas the intervening slots 43 achieve this structure with appropriate branchings. Given an axial movement of the contact piece 7, the spoke sections 42*a* are thus twisted opposite the spoke sections 42*b*, so that an axial excursion of the contact piece 7 occurs without significant rotational motion.

The mechanical stresses at the slot ends are reduced by the enlarged radii at the clamping locations. The arrangement of FIG. 6 enables an optimum length of the torsion region given a reduced space requirement.

Although various minor changes and modifications might be proposed by those skilled in the art, it will be understood that our wish is to include within the claims of the patent warranted hereon all such changes and modifications as reasonably come within our contribution to the art.

We claim as our invention:

1. A micromechanical electrostatic relay, comprising:

a base substrate having a base electrode layer thereon and a base contact piece thereon;

an armature substrate overlying the base substrate and having an armature spring tongue which is worked free from and integrally attached at one end to the armature substrate and which is free to move at its opposite free end, said armature spring tongue having an armature electrode layer thereon and an armature contact piece at said free end, said armature contact piece being provided on a contact spring section partially cut free at said free end;

said spring tongue in a quiescent condition forming a wedge-shaped air gap with its armature electrode layer relative to said base electrode layer, and said spring tongue conforming to the base substrate in a working condition when a voltage is present between the base electrode layer and the armature electrode layer so that the base contact piece and armature contact piece lie against one another with the contact spring section being a last portion of said armature spring tongue to be deformed; and said contact spring section being surrounded on all sides by said spring tongue and being axially symmetrically connected to the spring tongue via spring webs formed as a sun wheel whose spokes are limited by slots annularly arranged with mutual overlap and whose angular ranges total more than 360°; and wherein said contact spring section remains in a plane of the spring tongue except when the contact spring section contacts the base contact piece.

2. A relay according to claim 1 wherein the slots have a shape of helical sections concentrically interengaging.

3. A relay according to claim 1 wherein said angular ranges of the slots together yield 1.5 to 3 times a full circle.

4. A relay according to claim 1 wherein said contact spring section is held by spring webs forming two concentrically arranged sun wheels respective spokes of which have increasing radius in opposite directions.

5. The relay of claim 1 wherein said armature substrate comprises a silicon wafer.

6. A micromechanical electrostatic relay, comprising:

a base substrate having a base electrode layer thereon and a base contact piece thereon;

an armature substrate overlying the base substrate and having an armature spring tongue which is worked free from and integrally attached at one end to the armature substrate and which is free to move at its opposite free end, said armature spring tongue having an armature electrode layer thereon and an armature contact piece at said free end, said armature contact piece being provided on a contact spring section partially cut free at said free end;

said spring tongue in a quiescent condition forming a wedge-shaped air gap with its armature electrode layer relative to said base electrode layer, and said spring tongue conforming to the base substrate in a working condition when a voltage is present between the base electrode layer and the armature electrode layer so that the base contact piece and armature contact piece lie against one another with the contact spring section being a last portion of said armature spring tongue to be deformed; and said contact spring section being surrounded on all sides by said spring tongue and being axially symmetrically connected to the spring tongue by spring webs each of which have a first section meandering in a first direction and second section meandering in a reverse direction to the first section, and wherein said contact spring section remains in a plane of the spring tongue except when the contact spring section contacts the base contact piece.

7. The relay of claim 6 wherein said armature substrate comprises a silicon wafer.

8. A micromechanical electrostatic relay, comprising:

a base substrate having a base electrode layer and a base contact piece thereon;

an armature substrate overlying said base substrate and having an armature spring tongue which is worked free from and integrally attached at one end to the armature substrate and which is free to move at its opposite free end, said armature spring tongue having an armature electrode layer thereon and an armature contact piece at said free end, said armature contact piece being provided on a contact spring section partially cut free at said free end;

said spring tongue in a quiescent condition forming a wedge-shaped air gap with its armature electrode layer relative to said base electrode layer, and said spring tongue conforming to the base substrate in a working condition when a voltage is present between the base electrode layer and the armature electrode layer so that the base contact piece and armature contact piece lie against one another with the contact spring section being a last portion of said armature spring tongue to be deformed; and said contact spring section being surrounded on all sides by said spring tongue and being connected to the spring tongue via spring webs, and wherein said contact spring section remains in a plane of the spring tongue except when the contact spring section contacts the base contact piece.

9. The relay of claim 8 wherein said armature substrate comprises a silicon wafer.

* * * * *